US005651269A

United States Patent [19]

Prevost et al.

[11] Patent Number: 5,651,269

[45] Date of Patent: Jul. 29, 1997

[54] METHOD AND APPARATUS FOR LIQUEFACTION OF A NATURAL GAS

[75] Inventors: Isabelle Prevost, Conflans Sainte Honorine; Alexandre Rojey, Rueil Malmaison, both of France

[73] Assignee: Institut Francais du Petrole, Rueil Malmaison, France

[21] Appl. No.: 507,277

[22] PCT Filed: Dec. 26, 1994

[86] PCT No.: PCT/FR94/01535

§ 371 Date: Aug. 30, 1995

§ 102(e) Date: Aug. 30, 1995

[87] PCT Pub. No.: WO95/18345

PCT Pub. Date: Jul. 6, 1995

[30] Foreign Application Priority Data

Dec. 30, 1993 [FR] France ..... 93 15924

Feb. 21, 1994 [FR] France ..... 94 02024

[51] Int. Cl.[6] ..... F25J 3/00

[52] U.S. Cl. ..... 62/613

[58] Field of Search ..... 62/613

[56] References Cited

U.S. PATENT DOCUMENTS 2,903,858 9/1959 Bocquet ..... 62/613

*Primary Examiner*—Ronald C. Capossela

*Attorney, Agent, or Firm*—Antonelli, Terry, Stout & Kraus, LLP

[57] ABSTRACT

The method of the invention for liquefying a natural gas consists in liquefying at least a part of this gas by expanding it with mechanical energy, whereby during this expansion the gas changes from a dense phase to a liquid phase without undergoing a phase transition.

24 Claims, 6 Drawing Sheets

Figure 1:
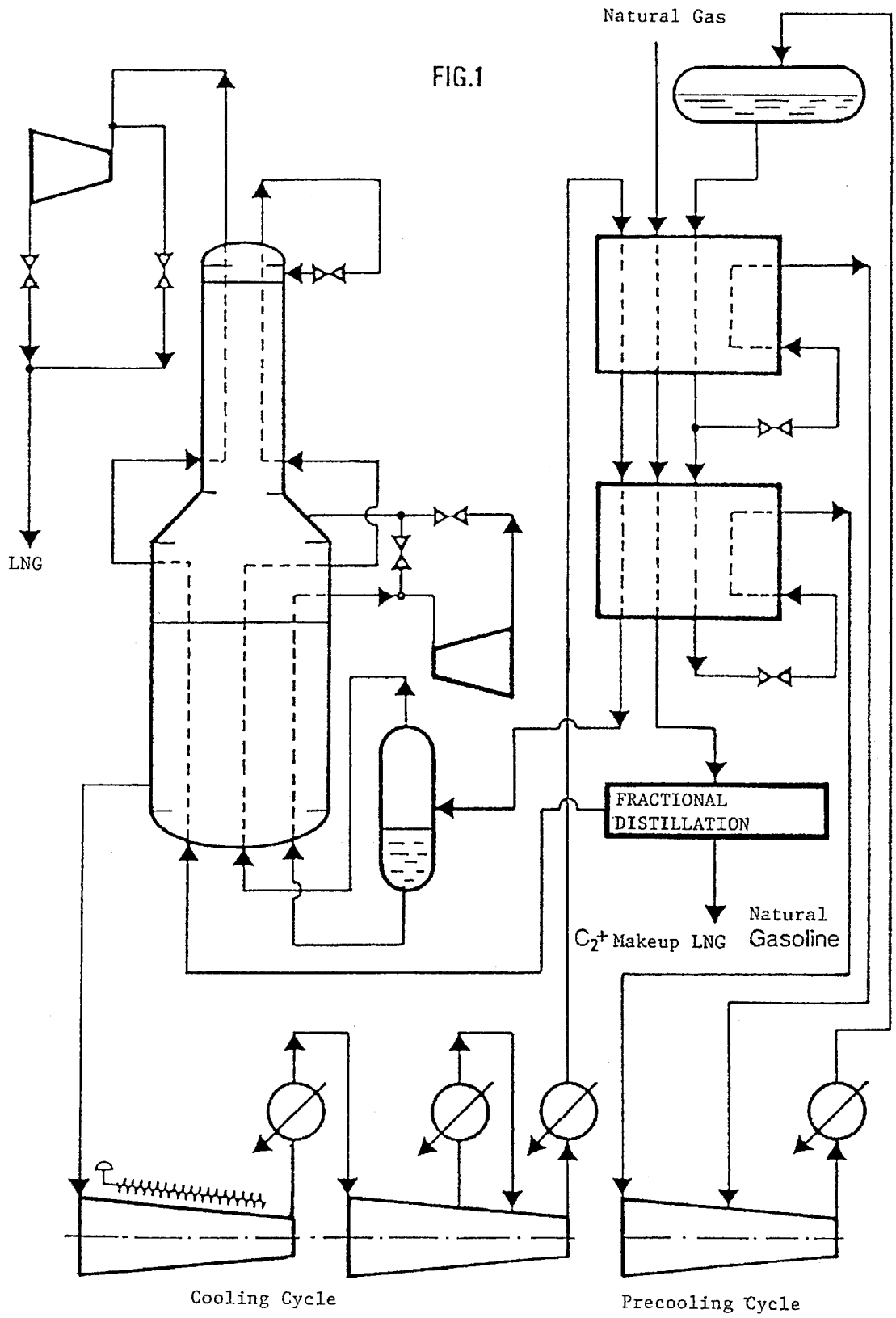

Natural Gas
LNG
FRACTIONAL DISTILLATION
$C_2^+$ Makeup LNG
Natural Gasoline
Cooling Cycle
Precooling Cycle

METHOD AND APPARATUS FOR LIQUEFACTION OF A NATURAL GAS

The liquefaction of natural gas is an important industrial process which enables natural gas to be transported by tanker over long distances or stored in liquid form.

The methods currently used to produce liquefaction of a "natural gas" involve passing this natural gas through exchangers and cooling it using an outside cooling cycle. U.S. Pat. No. 3,735,600 and U.S. Pat. No. 3,433,026 describe liquefaction methods during which the gas is fed through one or several heat exchangers to liquefy it. Throughout this text, by "natural gas" is meant a mixture formed for the greater part of methane but possibly containing other hydrocarbons and nitrogen, in whatever form it occurs (gaseous, liquid or two-phase). At the start, natural gas is most often in gaseous form and may take on different forms during the liquefaction process, liquid and gaseous, which may coexist at a given instant.

In such processes, an external cooling cycle is undertaken using a mixture of fluids as a cooling fluid. On evaporation, such a mixture is likely to cool and liquefy the gas under pressure. After evaporation, the mixture is compressed and condensed by a process of heat exchange with an ambient medium such as water or air.

Such methods are complex and involve the use of high exchange surfaces areas as well as high compression forces. As a result, they tend to require high capital investment.

It has been discovered, and this is the objective of the present invention, that after a first cooling stage, it is possible to cool and liquefy natural gas directly from a "dense" phase by expansion in a turbine. The expression "dense phase" denotes a phase which can be obtained from an initially gaseous phase by means of an isobar evolution without any phase transition, which leads as a result of isentropic expansion to a liquid phase without any phase transition. At least a part of the liquefaction process takes place without a transition phase, i.e. the change from the gaseous phase to the liquid phase occurs continuously without any transformation during which two different phases would exist at the same time. Natural gas is brought to the "dense phase" before expansion by applying pressure at a level at least greater than the critical pressure of methane and by lowering the temperature of the "natural gas".

The present invention relates to a method of liquefying a natural gas. It is characterised in that it comprises at least one step during which at least a part of this gas is liquefied by expansion with mechanical energy, this expansion causing it to change from the state of a dense phase to the state of a liquid phase.

The changeover between these two states occurs without any phase transition, i.e. without two different phases existing at the same time.

The method consists of, for example, at least the following two steps:

a) the natural gas is cooled at a pressure at least greater than or equal to the critical pressure of methane and at a temperature that will cause the natural gas to take on the form of the dense phase at the end of this cooling process, b) at least a fraction of this dense phase obtained from step a) is expanded and liquefied in a device designed to reduce the pressure of the natural gas by expansion with mechanical energy, the change from the state of dense phase to a state of liquid phase occurring without any transition phase, in order to form liquefied natural gas at least in part.

The pressure level of the liquefied natural gas at the end of step b) is virtually atmospheric pressure.

The expansion process of the liquid phase obtained during step b) continues until a gaseous fraction appears and the process can then move on to the following steps:

the liquid fraction and the gaseous fraction are separated during a step c), the gaseous fraction resulting from step c) is put through a heat exchange process with a non-expanded fraction of the natural gas during a step d), the non-expanded fraction being expanded after this heat exchange process during a step e) when a liquid-vapour mixture is formed and separated into a liquid fraction and a gaseous fraction, the liquid fractions from steps c) and e) are reunited to form the liquefied natural gas, at least a part of the gaseous fractions from steps c) and e) are recompressed and recycled to step a), and the gaseous fraction obtained at the end of step b) may be greater than or equal to 20%.

The device used to expand the natural gas and cause it to change from the state of a dense phase to the state of a liquid phase is, for example, a turbine.

During step a), the natural gas may be cooled by a heat exchange process using a gaseous fraction from the natural gas, this gaseous fraction being expanded in a turbine and the expanded gaseous fraction being at least partially recompressed in a compression process and then recycled.

At least one recycled gaseous fraction is compressed in two steps, during which the gas is cooled by an available ambient cooling medium as it leaves each of the compression stages.

During step a), the natural gas may also be cooled by evaporating a mixture of coolants, the mixture obtained in this manner being in vapour or gaseous phase. It is then compressed, condensed by a process of heat exchange with the ambient cooling medium available, expanded and recycled.

The mixture of coolants may be expanded and evaporated at at least two pressure levels.

If the natural gas contains heavy hydrocarbons, the heaviest of the hydrocarbons contained in the natural gas to be liquefied may be separated before step a) by means of an adsorption stage.

Step a) is carried out at a pressure level greater than the critical pressure of methane and preferably greater than the critical pressure of the mixture constituting the natural gas.

By preference, step a) is carried out at a pressure level greater than the cricondenbar of the natural gas to be liquefied.

Step a) is carried out a pressure level preferably in the range between 7 and 20 MPa.

The temperature of the natural gas at the end of step a) is preferably in the range between 165 and 230 K.

In the case of a natural gas containing heavier hydrocarbons than methane, at least a proportion of the hydrocarbons are separated during a preliminary stage carried out at a pressure level below the pressure level of step a).

During step a), the natural gas is expanded until a temperature is reached whereby after expansion, a liquid fraction concentrated with the hydrocarbons heavier than methane is produced, this liquid fraction then being separated.

Step b) is carried out, for example, by expansion in a turbine, the components of which are thermally insulated from the gas, since they are particularly poor heat conductors.

Step b) is, for example, carried out by expansion in a turbine having a rotor made from composite material.

The heat exchanges carried out during steps a) and d) may be carried out by passing the gas through counter-flow exchangers.

The heat exchange process of step d) may be implemented by passing the natural gas through an exchanger in which there is a temperature difference of less than 5 K on the coldest side of the exchanger and a temperature difference of less than 10 K on the hottest side of the exchanger.

Expansion during step b) can be carried out using at least two successive turbines, the liquid-vapour mixture from the first partial expansion being separated into a gaseous fraction and a liquid fraction, whereby the gaseous fraction is forwarded to step d) and the resulting liquid fraction is expanded in the second turbine so that at the end of this second expansion, the liquid fraction forms one part of the liquefied natural gas produced by the method.

At least a part of the gaseous fraction from step b) is, for example, brought into contact with the liquid fraction from step e) in counter-flow, after which the resulting liquid fraction is reunited with the liquid fraction from step b) to form the liquefied natural gas and the resulting gaseous fraction is reunited with the gaseous fraction from step e) to form at least a part of a gaseous fraction rich in nitrogen, which is evacuated.

The present invention also relates to a equipment designed to implement the method described above.

It is characterised in that it comprises a combination of at least one device E2 enabling the natural gas being liquefied to be cooled and brought to the dense phase and at least one cooling means R1, the device E2 being directly connected to at least one means T4 capable of expanding this natural gas in the dense form in order to liquefy it.

The means or device capable of expanding the natural gas in dense form comprises at least one expansion turbine, in which at least one of the elements is made from a material that is not very heat conductive. As a result, no heat is transferred to the elements of the turbine by heat conduction, which would reduce the efficiency of cooling by expansion.

The present invention therefore offers numerous advantages over the methods currently used in the prior art. In effect, the fact of working at an initial pressure value for the gas that is greater than the values used by the methods mentioned in the prior art makes it possible to reduce the energy needed to liquefy the natural gas.

In addition, by directly liquefying the natural gas by expansion, the surface areas of the heat exchangers required can be reduced and the method simplified, thus reducing the capital costs.

Figure 2:
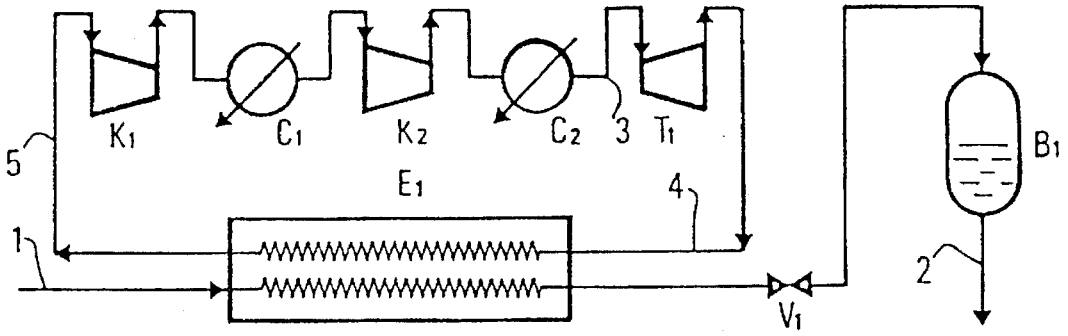
Figure 3C:
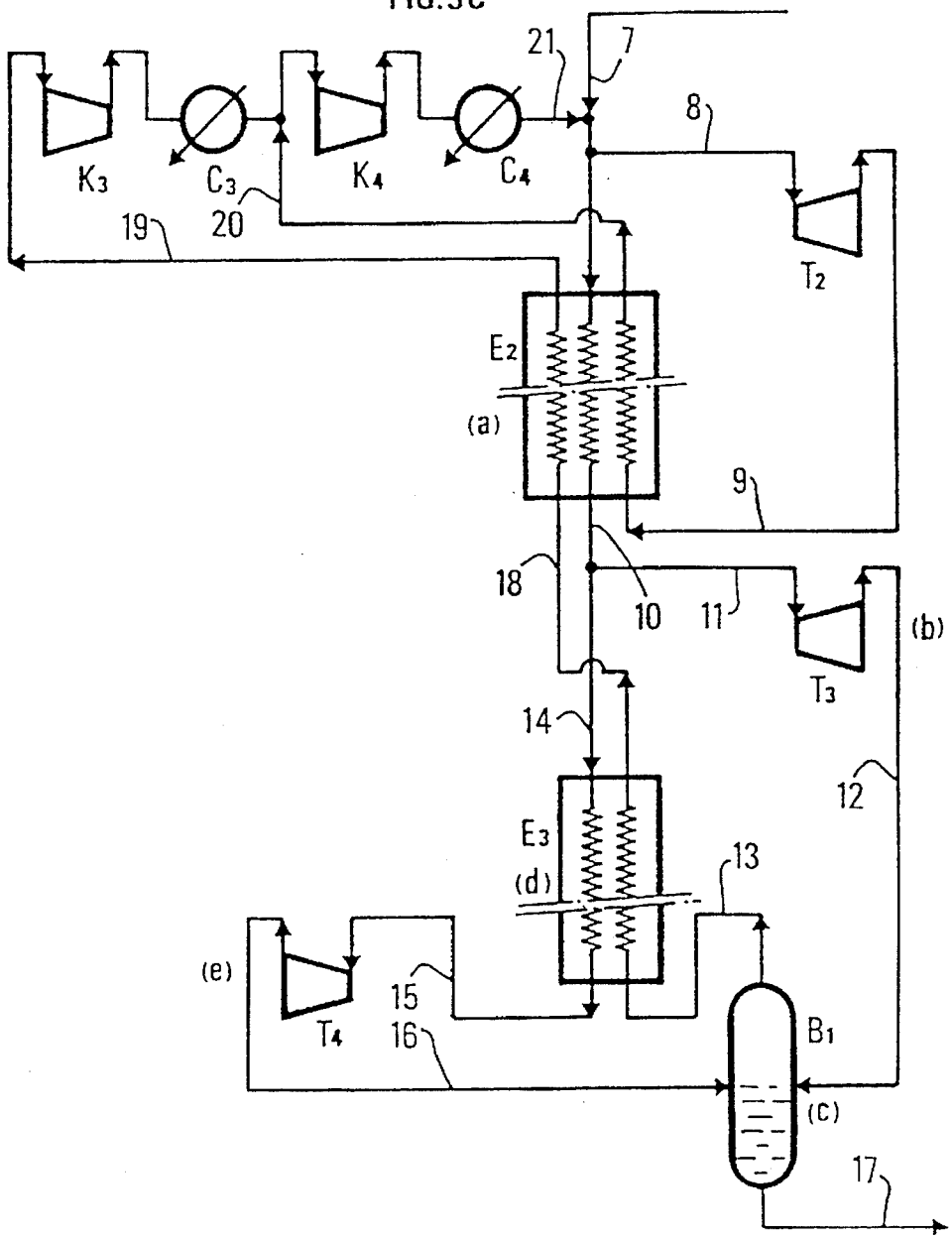
Figure 3A:
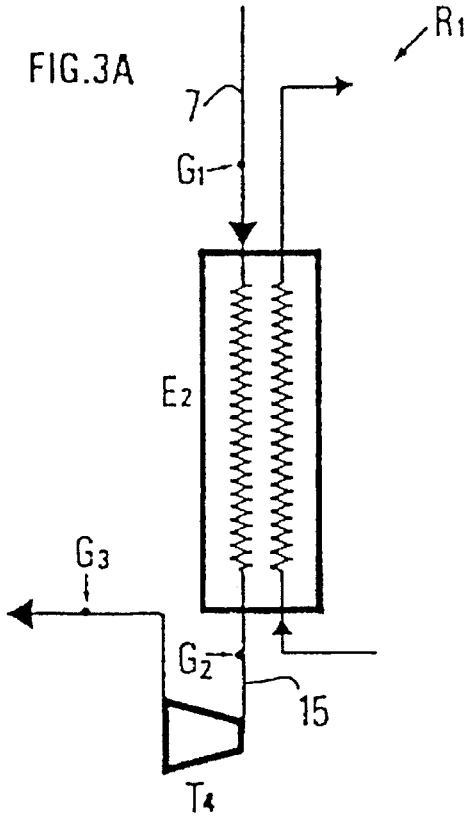
Figure 3B:
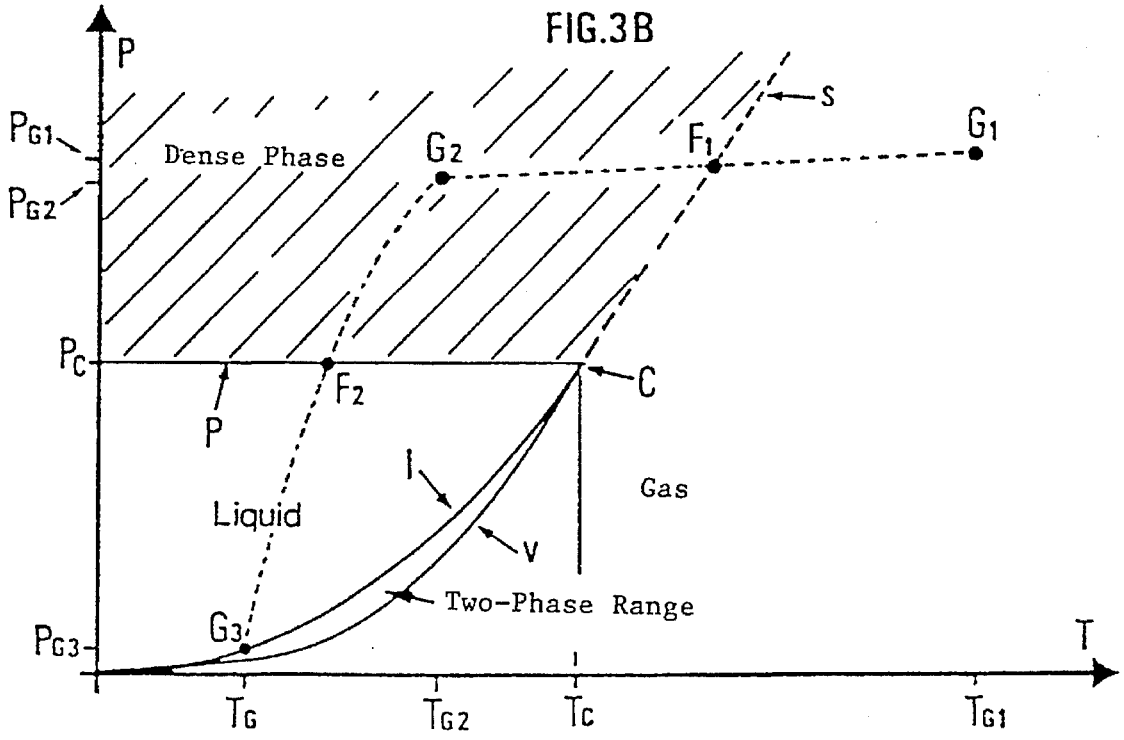
Figure 4:
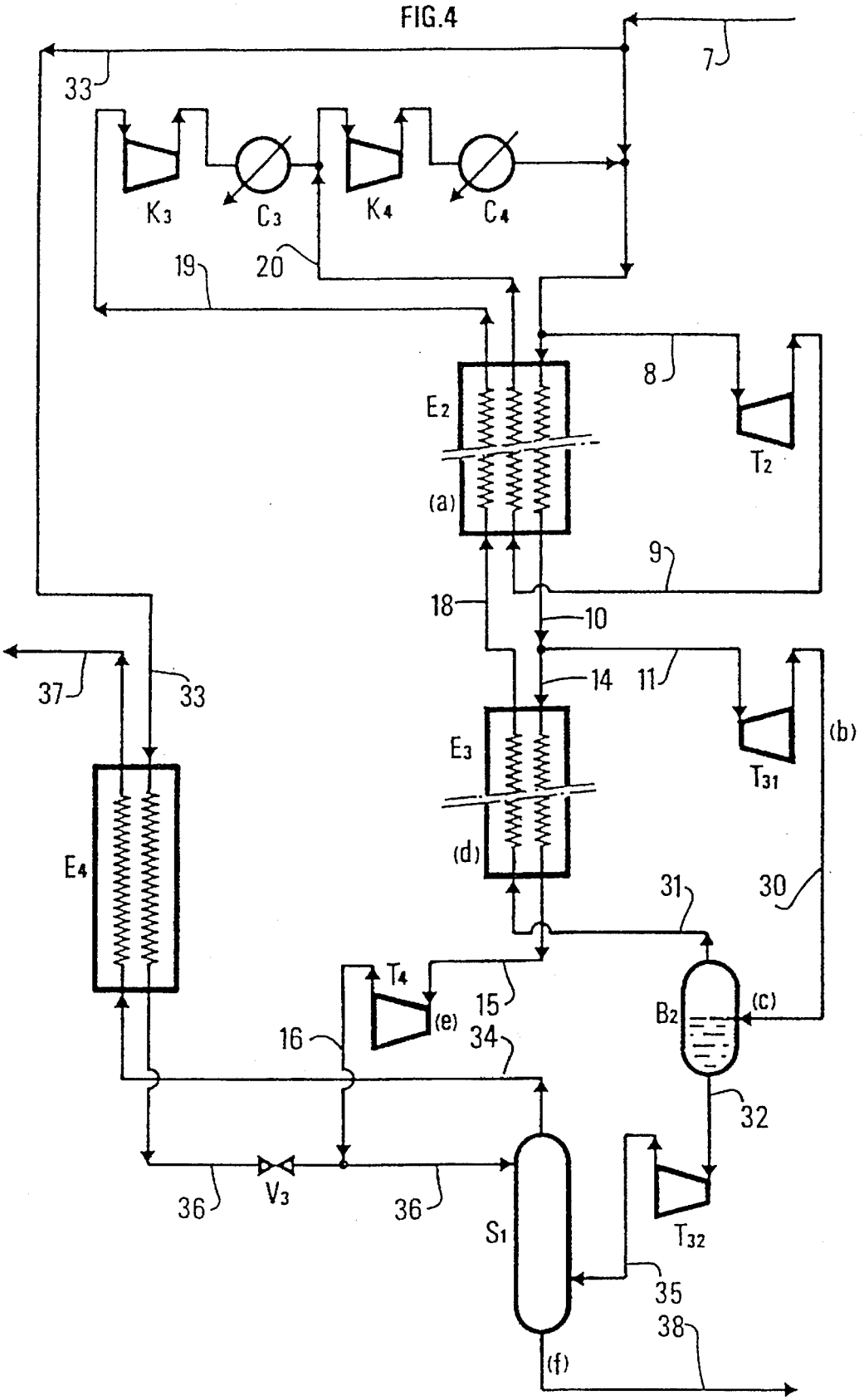
Figure 5:
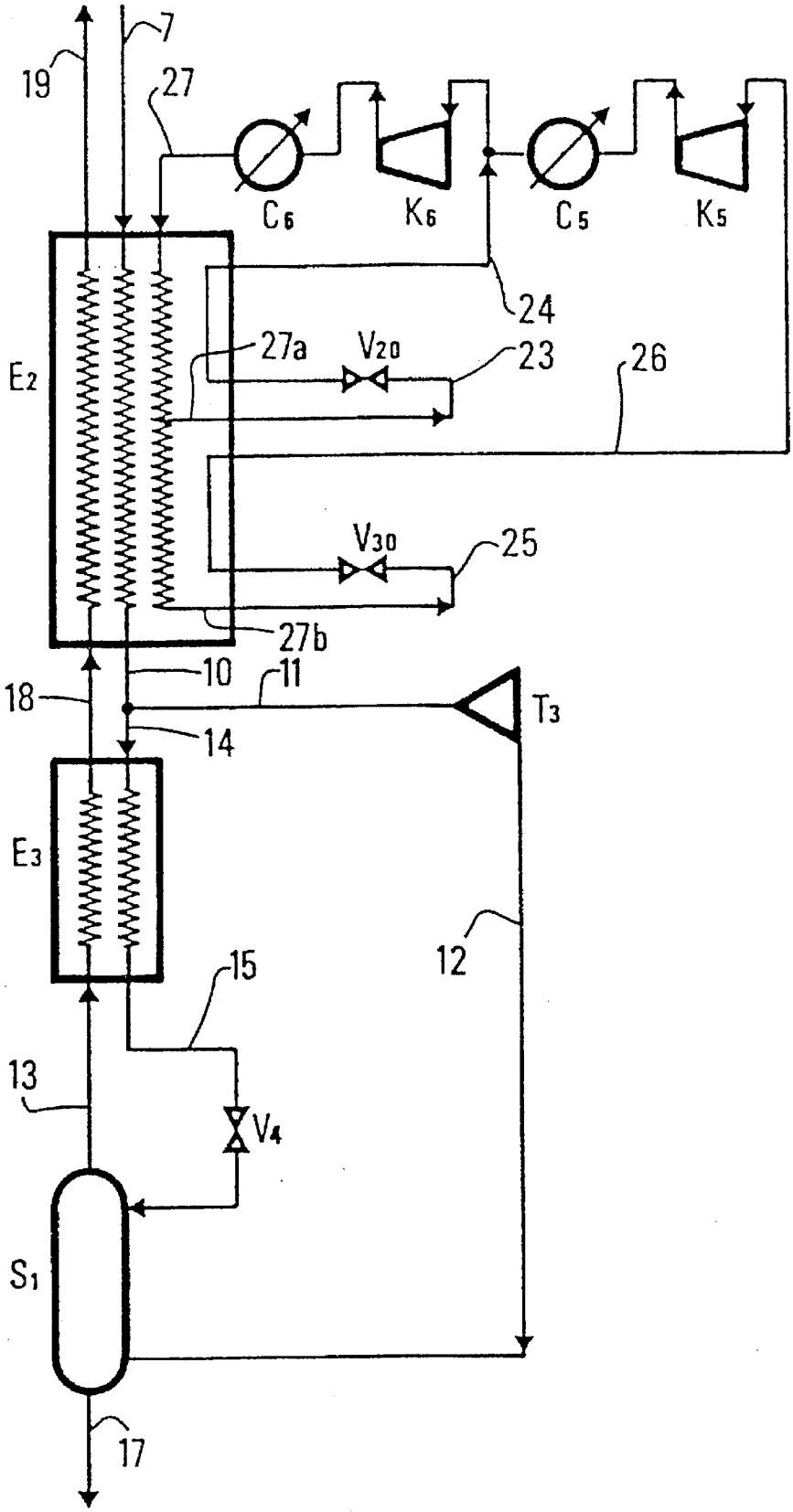
Figure 6:
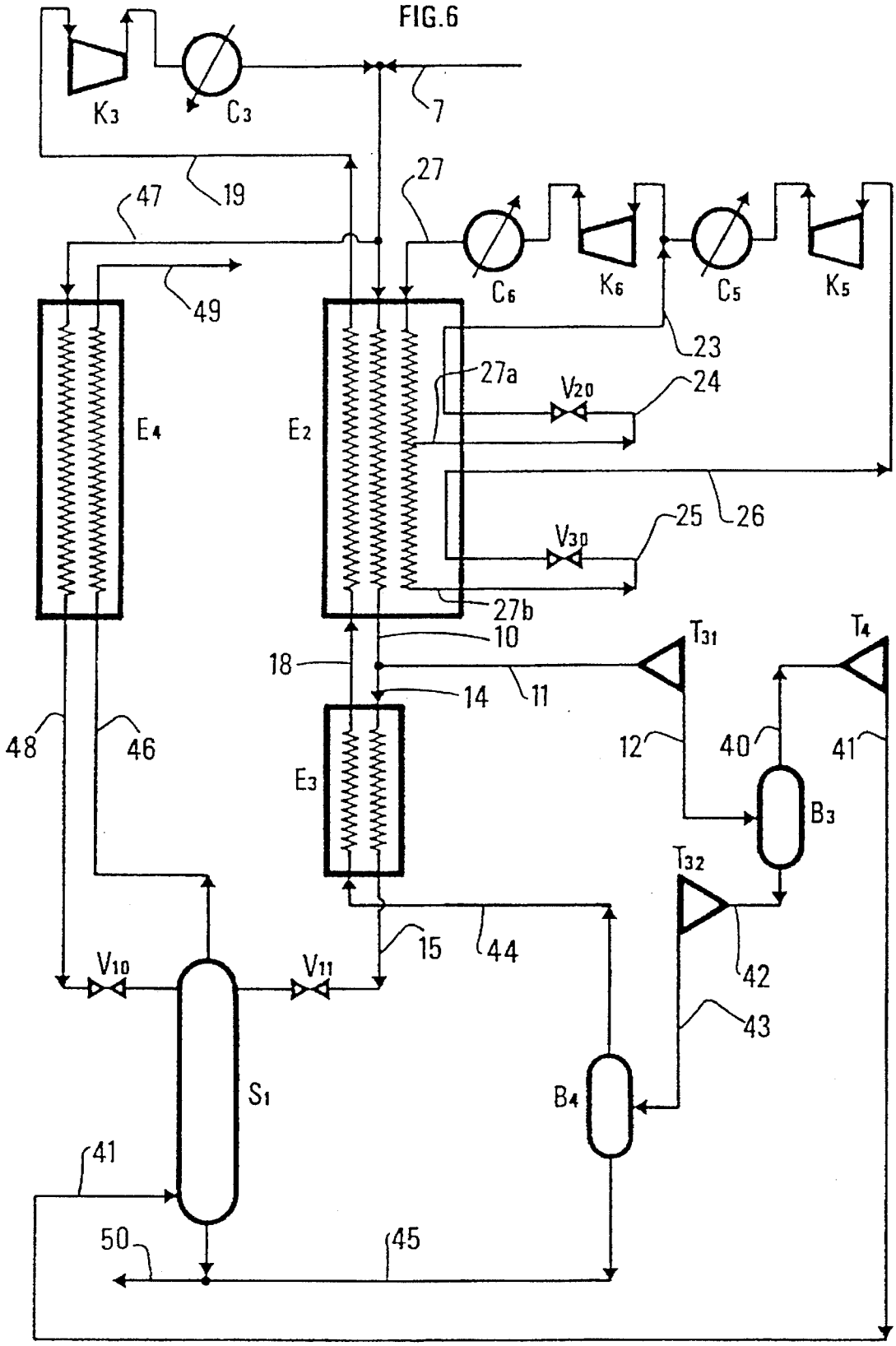

The present invention will be more readily understood and its advantages clearer from the description of several examples, which are not limitative, illustrated by the following drawings, in which:

FIG. 1 illustrates an example of a cooling cycle such as that described in the prior art, incorporating a pre-cooling cycle;

FIG. 2 describes an example of a cycle of the prior art using a permanent gas;

FIGS. 3A, 3B and 3C illustrate respectively the basic principle of the invention, a temperature diagram of the various phases for a natural gas, for example, and a specific embodiment;

FIG. 4 describes an embodiment designed to liquefy a gas containing nitrogen and partial separation of the nitrogen;

FIG. 5 describes an embodiment for which the pre-cooling stage is carried out using a mixture of coolants; and FIG. 6 describes an embodiment for liquefying a natural gas containing nitrogen, in which a part of the gaseous fraction produced by expansion is recycled, and the cooling stage is carried out using a mixture of coolants.

FIG. 1 is a theory diagram showing a method used in the prior art to liquefy a natural gas, for example.

The liquefaction process has a pre-cooling cycle which enables the mixture used in the main cooling cycle to be condensed.

In the pre-cooling cycle and the main cooling cycle, a mixture of fluids is used as the cooling fluid. On evaporation, this mixture is likely to cool and liquefy the gas under pressure. After evaporation, the mixture is compressed, condensed by a process of heat exchange with the ambient medium available, such as water or air, and recycled.

Another method of the prior art is to use a cycle operating with a permanent gas such as nitrogen. A system of this type is illustrated in FIG. 2.

The natural gas arrives under pressure by means of pipe 1. It then passes into the exchanger E1, in which it is liquefied and cooled. At the output of the exchanger E1, the liquefied natural gas is expanded to a pressure value close to atmospheric pressure as it is passed through an expansion valve V1 and is then evacuated via pipe 2.

The natural gas is cooled by a permanent gas flowing in the cooling cycle, which comprises a turbine T1, a pipe 4 connecting the turbine T1 to the exchanger E1 and a pipe 5 providing a passageway for the permanent gas from the exchanger to a series of compressors and cooling means arranged in a cascade configuration K1, C1, K2, C2, for example. The permanent gas flowing in the cooling cycle is then compressed in the compression stage K1, cooled as it is passes through the cooling medium C1, then conveyed to the compression stage K2 in which it is compressed ready for cooling as it is moved on to the cooling stage C2. The permanent gas compressed and cooled in this way is transferred via the pipe 3 to the turbine T1 in which it undergoes expansion and from which it emerges cooled, before being fed to the exchanger E1 by means of pipe 4. The permanent gas cooled in this manner cools the natural gas when they are brought into contact with each other in the exchanger E1. At the output of this exchanger and after the natural gas has been cooled, the permanent gas is moved on again and recycled to the compression and cooling stages by means of the pipe 5.

This type of cycle is used in small capacity units, especially because of its simplicity, but it is nevertheless acknowledged that its performance is markedly inferior to that of a cycle in which a mixture of coolants is used. Furthermore, it requires a very large flow of coolant gas to be recirculated.

Instead of the auxiliary permanent gas used as a coolant, such as nitrogen, a fraction of the gas to be liquefied can be used to fulfil the same function. The operating principle of the cycle illustrated in FIG. 2 remains identical to the principle described above.

The principle on which the invention described below is based is to start with a natural gas in the dense phase and reach a stage where it has been at least partially liquefied without undergoing any phase transition, i.e. at least a part of the liquefaction process occurs without any transition phase during which two phases of different natures would coexist. Throughout the liquefaction process, therefore, the changeover from the dense phase to the liquid phase occurs continuously, since a transition phase would mean that the changeover was discontinuous.

The method is essentially based on two steps, the first consisting in bringing the natural gas to the dense phase and the second in producing expansion with mechanical energy, for example a substantially isentropic expansion, causing the natural gas to change from the dense phase to the liquid phase.

The gas arrives in gaseous phase by means of the pipe 7 (FIG. 3A), in a thermodynamic state illustrated by point G1 (FIG. 3B) at an exchanger E2 in which it is pre-cooled at a given temperature in contact with a cooling agent from the cooling cycle R1. When it leaves the exchanger E2, the natural gas is in the dense phase, at point G2 (FIG. 3B). It is then transferred by pipe 15 from the exchanger E2 to the turbine T4 in which it is expanded. After passing through the turbine T4, it is at least partially in liquid phase at point G3. The transformation from the dense phase to the liquid phase occurs by means of expansion with mechanical energy and without any transition phase.

The liquid phase obtained at point G3 after expansion is, for example, a saturated liquid phase. As the expansion process proceeds with this saturated liquid phase, a gaseous or vapour fraction appears which, after the heat exchange process, can be recycled or used elsewhere. It is used, for example, as a fuel on the liquefaction installation site.

The process is illustrated in a chart giving pressure (P) and temperature (T) data as shown in FIG. 3B. In this diagram, inside the two-phase area, a liquid phase and a gaseous phase occur together. Three areas can be defined outside of this two-phase area. The area of the gaseous phase is delineated by the vapour branch v (condensation curve) from the two-phase area and the isentropic curve s passing through the critical point C. The area of the dense phase is delineated on the one hand by the isentropic curve s and on the other by the isobar p passing through the critical point C. The area of the liquid phase is delineated on the one hand by the isobar p and the liquid branch 1 (bubble curve) from the two-phase zone.

The changes undergone by the natural gas during the method of the invention occur as follows:

The natural gas to be liquefied is initially in a gaseous phase represented by a point G1 at a temperature $T_{G1}$ and a pressure $P_{G1}$. It is then cooled under substantially isobar conditions so as to bring it to a state of dense phase as represented by the point G2 at a pressure and temperature of $P_{G2}$ and $T_{G2}$ respectively. The changeover from G1 to G2 occurs, for example, continuously, without any transition phase, passing through the point F1 of the isentropic line p delineating the gaseous phase section of the dense phase area. The natural gas in the dense phase, point G2, is then expanded in a substantially isentropic manner to change it from a state of saturated liquid phase as shown by point G3 which is, for example, on the liquid branch 1 from the two-phase area, corresponding to temperature and pressure values of $T_{G3}$ and $P_{G3}$. The value of the pressure $P_{G3}$ is, preferably, substantially equal to that of atmospheric pressure. The changeover from the state represented by the point G2 to the state represented by point G3 occurs by passing though the point F2 of the isobar p delineating the dense phase section of the liquid phase area, continuously and without a transition phase, i.e. without the coexistence of two different phases.

As stated above, expansion can be continued in the two-phase area by generating a vapour or gaseous fraction.

In a preferred version of the method of the invention, the temperature at the end of the cooling stage preceding the expansion stage is in the range between 165 and 230 K.

It has been discovered that in order to operate under such conditions whilst maintaining the pressure level in the range between 7 and 20 MPa during step a), it is necessary to allow for a value of the gaseous fraction greater than a minimum value, for example 20%, at the end of the expansion stage.

The following description of the method of the invention in relation to FIG. 3C illustrates the application of the method to the liquefaction of a natural gas.

The natural gas arrives through a pipe 7 at an exchanger E2 at a pressure level at least higher than the value of the critical pressure of methane, where it is cooled to a temperature in the range, for example, of between 165 K and 230 K. This stage of pre-cooling the gas is carried out, for example, by diverting a fraction of the natural gas before it enters an exchanger E2 by means of a pipe 8, which transfers this diverted fraction to an expansion turbine T2. The diverted fraction is cooled during the expansion process, which is carried out in gaseous phase in the turbine T2, and is then forwarded to the exchanger E2 by means of a pipe 9. The diverted and cooled gaseous fraction is therefore used as a cooling agent and makes it possible to reduce the temperature of the natural gas entering the exchanger T2. Any external coolant having the characteristics that will enable a gas to be cooled may be used instead of the diverted and cooled fraction of natural gas.

The natural gas thus leaves the exchanger E2 cooled and in the "dense" phase via a pipe 10. A fraction of this "dense" phase is sent directly by a pipe 11, for example, to an expansion turbine T3. At the output of the turbine T3, a mixture is obtained made up for the greater part of liquid phase, for example. By means of a pipe 12, the mixture is evacuated at a pressure close to atmospheric pressure from the turbine T3 to a separator flask B1 in which the liquid and gaseous fractions are separated. The gaseous fraction is taken from the flask B1 and is conveyed by a pipe 13 to an exchanger E3.

The cooled fraction of natural gas in the "dense" phase from the exchanger E2 that was not transferred to the turbine T2 is passed via a pipe 14 to an exchanger E2 in which it is cooled by a process of heat exchange with the gaseous fraction arriving via the pipe 13. The natural gas cooled in this way leaves the exchanger E3 at a lower temperature than its temperature when it entered this exchanger, for example, a temperature close to the temperature of the gaseous fraction arriving through pipe 13. It is then sent by means of a pipe 15 to a turbine T4 in which it is expanded. The mixture obtained at the output of the turbine T4 is for the greater part liquid phase and is sent via a pipe 16 to the separator flask B1. The two fractions of liquid phase collected in the flask B1 form the liquefied natural gas which is evacuated by means of a pipe 17.

When expanding this type of dense phase, i.e. a phase such as that obtained from one or several turbine(s) after the first step of the invention, cooling is applied and a mixture is obtained, for example directly on leaving the last expansion stage, which contains mostly a liquid phase at a pressure close to atmospheric pressure and at a temperature close to the boiling temperature of methane (111.66 K).

After the separation process described above, the gaseous fraction from the separator flask B1 passes through a pipe 13 into the exchanger E3 and is then sent by means of a pipe 18 to the exchanger E2, from which it emerges at a temperature close to the temperature of the natural gas being liquefied as it was at the start. It is then moved on to a compression stage K3 via a pipe 19. At the end of the compression stage K3, the gaseous fraction is cooled by a process of heat exchange with the ambient medium, water or air, available in an exchanger C3 and is then mixed with a gaseous fraction from the expansion process carried out in the turbine T2 on the gaseous part initially diverted before the exchanger E2, this gaseous fraction coming from the exchanger E2 via a pipe 20 connected to and opening into the pipe 19, for example, between the exchanger C3 and a compression stage K4. The gaseous mixture thus obtained is compressed in the compression stage K4 and then cooled by a process of heat exchange with the ambient medium, water or air as available. The gaseous mixture thus compressed and cooled is recycled via the pipe 21 and mixed with the natural gas to be liquefied arriving by means of the pipe 7.

It may be of advantage to replace each of the compression stages K3 and K4 with a succession of compression stages, so that the gaseous mixture leaving one compression stage is cooled by heat exchange with the ambient medium available, water or air, before being sent on to the following stage so as to approximate the compression process to isothermal compression as effected at a temperature close to the temperature of the ambient medium, water or air as available.

The method of the invention consists in implementing at least the following two stages:

1) during a first step a), the natural gas is cooled at a pressure that is at least greater than the critical pressure of methane and at a temperature that will ensure that the natural gas is in the dense phase at the end of this cooling stage, 2) at least a part of the fraction of the dense phase obtained from step a) is expanded and liquefied by means of a device designed to reduce the pressure of the natural gas, such as a turbine, by expansion with mechanical energy, the changeover from the state of the dense phase to a state of liquid phase occurring without any transition phase.

The expansion process is continued until a gaseous fraction appears and the method moves on to the following steps:

3) the gaseous fraction and the liquid fraction resulting from step b) are separated during a step c), 4) the gaseous fraction resulting from step c) is put through a heat exchanged process with a non-expanded fraction of the natural gas during a step d), this non-expanded fraction being expanded after this heat exchange process during a step e), to form a liquid-vapour mixture which is separated into a liquid fraction and a gaseous fraction, 5) the liquid fractions from steps c) and e) are reunited during a step f) to form the liquefied natural gas, and 6) the gaseous fractions from the steps d) and e) are at least partially recompressed and recycled to step a).

If the natural gas contains heavier hydrocarbons than methane, the critical pressure of the mixture constituting the natural gas is greater than the critical pressure of methane. In this case, the pressure at which step a) is carried out is preferably greater than the critical pressure of this mixture.

Preferably, the pressure at which step a) is carried out is also greater than the cricondenbar defined for a mixture as being the pressure above which two phases may not coexist.

In the instance illustrated by FIG. 3C, the fraction of natural gas in the "dense" phase which has not been expanded in the turbine T3 is cooled in the exchanger E3 to a temperature close to the final temperature of the liquefied natural gas produced.

The natural gas fraction expanded in the expansion turbine T3 is a majority fraction of the natural gas present at the input, this fraction being preferably greater than two thirds of the natural gas present at the input of the exchanger E3 arriving via the pipe 10.

The expansion operation used to expand the natural gas is, for example, recuperated in the turbines T3 and T4 and used, for example, to drive the compression stages K3 and K4 and/or, in the case of the illustrations shown in FIGS. 5 and 6, the compression stages K5 and K6. Any additional mechanical energy that might be needed is supplied, for example, by a steam turbine or, preferably, a gas turbine.

It may be to advantage to place on a same circuit two or several compression stages as well as two or several turbines.

By increasing the pressure level at which step a) is carried out, it is possible to reduce the additional mechanical energy needed to liquefy the natural gas.

The method of the invention is all the more advantageous if the pressure at which step a) is carried out is high. The pressure applied must be at least equal to the critical pressure of methane (4.6 MPa) and, preferably, greater than the cricondenbar of the mixture constituting the natural gas to be liquefied. Preferably, it should be in a range between, for example, 7 and 20 MPa.

By lowering the temperature at the end of step a), the quantity of the gaseous phase recycled at the end of the expansion process carried out in step c) is reduced. As stated above, the temperature should preferably be in the range of 165 K and 230 K.

If the natural gas contains heavier hydrocarbons than methane, these hydrocarbons are, for example, at least partially separated from the natural gas before the liquefaction process, in particular in order to avoid any risk of crystallisation during liquefaction.

If the pressure is greater than the cricondenbar, the hydrocarbons that are heavier than methane cannot be condensed by cooling. In this case, it has been discovered that it is preferable to separate using an adsorption process on an adsorbent comprising, for example, an alumina, a zeolite or an active carbon.

The adsorbent is applied, for example, in at least two fixed beds operating in parallel. One bed operates, for example, by adsorption whilst another bed operates by desorption. The desorption is carried out, for example, by decreasing the pressure and/or increasing the temperature. The hydrocarbons that are heavier than methane and have to be separated fix on the adsorbent during the adsorption stage and are then separated during the desorption stage.

Another method that may be used if the natural gas contains heavy hydrocarbons is to cool the natural gas during step a) to a temperature at which, at the end of a substantially isentropic expansion which has brought the gas to a pressure level lower than the cricondenbar of the mixture, a liquid phase forms by retrograde condensation. The expanded mixture is then cooled at a substantially constant pressure. The liquid phase containing the hydrocarbons that are heavier than methane, which has to be separated, is then diverted at the end of the expansion process and/or during the subsequent cooling of the mixture, which is carried out at a substantially constant pressure.

If the natural gas contains hydrocarbons that are heavier than methane, it is also possible to separate these hydrocarbons during a preliminary process carried out a pressure level lower than the pressure at which step a) is carried out. In this case, if the pressure during the preliminary stage is lower than the cricondenbar, the hydrocarbons that are heavier than methane may be separated by other, known, means such as condensation means, distillation and/or adsorption in a solvent, for example, at a temperature lower than the ambient temperature.

At the end of this preliminary stage, the gas may be compressed by means of a compression stage carried out under conditions as close as possible to those of an isothermal compression in which compression stages are alternated with cooling stages, the cooling being carried out using a cooling fluid, air or water as available, for example on the liquefaction site.

Generally speaking, such a preliminary compression stage is used if the pressure of the gas to be liquefied is not sufficient to carry out step a) under satisfactory conditions.

In particular, such a compression stage may become necessary if the pressure of the gas at the head of the well becomes too low, for example, at the end of a period during which the natural gas deposit has been worked.

If the natural gas to be liquefied contains nitrogen and if necessary, at least some of this nitrogen can be separated.

This is done, for example, in the following manner;

It has been discovered that at the end of the expansion process carried out in step b), it is possible to obtain a gaseous phase with a high nitrogen concentration and then separate at least a fraction of the nitrogen contained in the natural gas to be liquefied without having to liquefy this nitrogen fraction in the mixture with the natural gas. In effect, liquefying natural gas in the presence of this nitrogen fraction is doubly problematic since the presence of the nitrogen fraction makes the liquefaction operation more difficult and the nitrogen fraction then has to be separated from the liquid phase obtained, for example, by a distillation process.

In this instance, the method is implemented as illustrated in FIG. 4, for example.

The natural gas is sent to the exchanger E2 via the pipe 7. At the end of the cooling process in the exchanger E2, the natural gas leaves in the form of a "dense" phase. The fraction of this "dense" phase may be expanded directly by at least two successive expansion stages as described below.

A first fraction of the dense phase is sent through the pipe 11 from the output of the exchanger E2 to a turbine $T_{31}$ where it is expanded. At the end of this first expansion stage, the mixture obtained by expansion is evacuated by means of a pipe 30 from the turbine $T_{31}$ to a separator flask B2 in which the liquid and gaseous fractions of the mixture are separated. The gaseous fraction is, for example, sent or recycled by a pipe 31 to the exchanger E3.

The nitrogen content of the liquid fraction separated in the separator flask B2 is reduced and the fraction is then evacuated via a pipe 32 to a turbine $T_{32}$ where it is expanded and from where it emerges in the form of a liquid-vapour mixture. On leaving the turbine $T_{32}$, the liquid-vapour mixture obtained is conveyed to the base or lower part of a contactor S1 by means of a pipe 35.

The cooled fraction of natural gas in dense phase from the exchanger E2 that has not been diverted to the turbine $T_{31}$ is sent by a pipe 14 to the exchanger E3. It is cooled in this exchanger by a process of heat exchange with the gaseous fraction from the pipe 31. On leaving the exchanger E3, the fraction in dense phase is at a lower temperature than its temperature when it initially entered the exchanger E3, essentially close to the temperature of the gaseous fraction arriving via pipe 31. This fraction in dense phase leaving the exchanger E3 is sent conveyed by means of a pipe 15 to a turbine T4, in which it is expanded. The liquid-vapour mixture, made up for the most part of liquid phase obtained after expansion at the output of the turbine t4 is sent to the head of the contactor S1, which is the upper part of the contactor, by means of a pipe 36. The liquid phase leaving the turbine T4 has a relatively high concentration of nitrogen. In the contactor S1, it is brought into contact in counter-flow with the gaseous fraction arriving at the base of the contactor S1 via pipe 35, the composition of which is close to equilibrium with a liquid phase that is relatively poor in nitrogen content. In the contactor S1, the liquid phase which is descending reduces in nitrogen content and the gaseous phase which is rising increases in nitrogen content. It is therefore possible to obtain at the base of the contactor S1 a liquid fraction that is relatively poor in nitrogen content and at the head of the contactor S1 a gaseous fraction that is relatively rich in nitrogen. The liquid fraction collected at the base of the contactor S1 forms the liquefied natural gas and is evacuated via a pipe 38. The gaseous fraction collected at the head of the contactor S1 forms the concentrated nitrogen gaseous fraction which is separated from the natural gas.

This gaseous fraction which has a high nitrogen concentration is evacuated via a pipe 34 and sent to an exchanger E4 from which it leaves by means of a pipe 37. In the exchanger E4, the gaseous fraction with a high nitrogen concentration is heated by a process of heat exchange with a fraction of the natural gas diverted from the natural gas arriving via a pipe 33, which directly links the inlet pipe 7 of the natural gas to the exchanger E4.

This fraction of natural gas diverted directly from the inlet pipe 7 is cooled in the exchanger E4 then expanded through an expansion valve V3 located on the pipe 36 linking the exchanger E4 with the contactor S1. The fraction of natural gas diverted and expanded is then mixed with the liquid-vapour mixture from the turbine T4 and sent to the contactor S1, the two liquid vapour fractions being mixed together at the level of the pipe 36.

It is also possible to send the gaseous fraction leaving the head of the contactor S1 to the heat exchangers E3 and E2, which, in this case, would have to have additional heat exchange means.

The contactor is, for example, a lagged column element or a platform column. The number of theoretical stages in the contactor S1 is, for example, 3 or 4.

An example of the way in which the method of the invention operates is described below.

Taking a natural gas that has to be liquefied and is at a temperature of 308 K and a pressure of 150 bars and contains 7.7% mass of nitrogen:

A first fraction f1 of this natural gas is cooled by the exchangers E2 and E3 to a temperature of 122 K. When it leaves the exchanger E3, the natural gas is therefore in a state of "dense" phase. It is then liquefied at least partially by expansion in the turbine T4, for example, at atmospheric pressure and is then fed by the pipe 16 to the head of the contactor S1.

A second fraction f2 taken from upstream of the exchanger E2 is cooled to 185 K by a substantially isentropic expansion in the turbine T2 to the region of its condensation pressure. This cooled and expanded fraction is then fed by means of pipe 9 into the exchanger E2 where it is heated by counter-flow with the first fraction f1. At the end of this exchange, the fraction f2 passes through a series of compressors cooled by the ambient medium K4, C4, in which it is compressed and cooled, and it is then mixed with the natural gas to be liquefied, which arrives by means of the pipe 7.

A third fraction f3 is diverted from the output of the exchanger E2 and cooled, for example, to 117 K by a substantially isentropic expansion in a turbine $T_{31}$. The gaseous fraction is separated from the gas/liquid mixture obtained by expanding the fraction f3 in the flask B2, and transferred via the pipe 31 to the exchanger E3, then via the pipe 18 to the exchanger E2, where it is heated by counter-flow with the first fraction f1. At the end of this heating process, the fraction f3 passes through a series of compressors K3, C3, cooled, for example, by the ambient medium, and is then mixed with the second fraction f2 upstream of the series of compressors K4, C4, also cooled by the ambient medium, for example.

The liquid fraction from the flask B2 is expanded by passing it through the turbine $T_{32}$ at atmospheric pressure and introduced into the lower section, for example, at the base of the contactor S1. In contact with the liquid located in the upper part of the contactor, which is rich in nitrogen (6.7% mass), the vapour fraction or gaseous fraction becomes enriched with nitrogen. At the output of the contactor S1, the vapour fraction contains 66% mass of nitrogen and the liquefied natural gas 1.3% mass of nitrogen. This vapour fraction is heated to ambient temperature by a fraction f4 of the natural gas to be processed and is fed to the head of the contactor before being rejected.

The fractions f1, f2, f3 and f4 are selected so that thermal approximation with the exchangers is minimal.

The losses in methane in the purged gas amount to 3.5%.

The expansion carried out during step b) is accompanied by a large variation in temperature which is, for example, greater than 50° C. If expansion is carried out in two or several successive turbines, the result is a relatively large difference between the input and output temperatures of each turbine. Furthermore, the expansion is applied to "dense" or liquid phase. The heat exchanges between the fluid during expansion and the elements of the turbine may, under these conditions, reduce the efficiency of the expansion process.

It has been discovered to be of advantage if the expansion process is carried out in one turbine whose elements are made from materials that are not very heat conductive. They are thus thermally insulated from the natural gas.

These elements may be metal components coated with a thermal insulation layer. These elements, and in particular the rotor, may also be made from a composite material with low heat conductivity.

The heat exchanges occurring during steps a) and d) are carried out in counter-flow heat exchangers. These heat exchangers are, for example, multi-pass exchangers and are, preferably, plate exchangers. These plate exchangers may be, for example, of brazed aluminium. It is also possible to use stainless steel exchangers whose plates are welded to each other.

The pipes through which the fluids used for the heat exchange flow can be made by different means, for example, by arranging corrugated separating plates between the plates, by forming plates by explosion, for example, by grooved plates, or for example by chemical engraving.

It is also possible to use wound exchangers. In this case, the heat exchange of heat of step e) is then carried out with a temperature difference of preferably less than 5 K on the coldest side of the exchanger and a temperature difference of preferably less than 10 K on the hottest side of the exchanger.

It is also possible within the scope of the invention to apply cooling at step a) by means of an external cycle operating with a mixture of coolants. The operating principle of the method in this instance is illustrated in FIG. 5, for example.

In this instance, the first stage of cooling the natural gas is performed in the exchanger E2, such as a plate exchanger, and instead of causing by heat exchange by expansion using a cooled gaseous fraction as described above, a mixture of coolants is used, which evaporates in the exchanger E2.

The mixture of coolants comes from cycle A comprising, for example, an assembly of pipes, compressures, exchangers and evolves as described below.

The mixture of coolants id evaporated at two pressure levels which may be successive to increase the temperature range over which cooling can take place.

This mixture is fed, for example, into the exchanger E2 by a pipe 27 which splits into two pipes 27*a* and 27*b*. A first part of the mixture of coolants in liquid phase is firstly evacuated by a pipe 23, forming an extension of pipe 27*a*, from the exchanger E2 to a first expansion valve V20, in which it is evaporated at a temperature, for example, ranging between 238 and 303 K, is then passed back through the exchanger E2 and emerges in gaseous or vapour form to be sent on to the compression K6 by a pipe 24.

A second part of the mixture passes through sub-pipe 27*b* and is then evacuated from the exchanger E2 to a valve V30 located on a pipe 25 extending the sub-pipe 27*b*. The mixture is expanded by the valve V30 to a pressure level close to atmospheric pressure and evaporated, for example, at a temperature ranging between 173 and 238 K. The vapour phase thus obtained is sent from the exchanger E2 to the input of a compressor K5, then cooled in an exchanger C5 located after the compressor K5 and mixed with the vapour fraction arriving via the pipe 24. The mixture in vapour phase thus obtained is then compressed in the compressor K6, cooled and condensed by being passed through an exchanger C6 before being fed by pipe 27 to the exchanger E2 where it is sub-cooled before being expanded and evaporated.

The natural gas arrives via the pipe 7 and leaves the exchanger E2, cooled, via a pipe 11. On leaving the exchanger E2, its temperature is, for example, close to 178 K in the mixture form. The greater part of this mixture passes through a turbine T3 in which it is expanded and from which it emerges in the form of a liquid-vapour mixture which is then fed via a pipe 12 to the base of a contactor S1.

The other part of the natural gas that has been passed through the turbine T3 is sent directly from the exchanger E2 to a plate exchanger E3 by a pipe 14, where it is cooled, for example, by exchange with the fraction in vapour phase coming from the contactor S1 via a pipe 13, until a temperature is reached that is close to the final temperature of the liquefied natural gas produced.

The gaseous fraction cooled in the exchanger E3 leaves this exchanger by means of a pipe 15 and is expanded through an expansion valve V4. The liquid fraction obtained by expansion is sent to the head of the contactor S1.

Inside the contactor S1, this liquid phase is deprived of nitrogen whilst the fraction in vapour phase fed to the bottom of the contactor S1 rises up the contactor and becomes enriched with nitrogen. The fraction in vapour phase which leaves the contactor S1 is therefore charged with nitrogen, which allows the major part of the nitrogen initially contained in the natural gas to then be evacuated.

The gaseous fraction rich in nitrogen passes through the exchanger E3, then via the pipe 18 into the exchanger E2, from which it leaves via a pipe 19.

The liquefied natural gas resulting from the liquid fraction that has been deprived of nitrogen is extracted from the lower part of the contactor S1.

The contactor S1 may be, for example, a platform column or a lagged column. If a lagged column is used, the lagging may advantageously be of the "structured" type.

Various modifications to the diagram shown in FIG. 5 as an example of an embodiment may be considered whilst still remaining within the scope of the invention.

In particular, during the cooling stage carried out in the exchanger E2, it is possible to modify the number of pressure levels at which the mixture in liquid phase is expanded. In the illustration shown in FIG. 5, there are two such levels but this may be reduced to one or, on alternatively, fixed at three or more. By increasing the number of expansion pressure levels, the power of the compression needed, for example, is reduced but the complexity of the installation is increased. The choice as to how many expansion pressure levels should be applied is therefore one of technical versus economic considerations.

The expansion valves V20, V30 and V4 may be substituted in full or in part by motorised expansion turbines.

The exchangers E2 and E3 may be made of different materials and/or assembly configurations. It is also possible to configure the series of heat exchangers in one single-plate exchanger.

The compressors K5 and K6 may each have a series of stages. It is possible to provide a step for intermediate cooling between two successive stages.

At least part of the low pressure gaseous fraction evacuated by means of the pipe 19 may be recompressed and recycled. Clearly, since the gaseous fraction thus obtained may be used at low pressure, without being recycled, it is possible to reduce the capital costs and operating expenses necessary considerably.

If the natural gas contains nitrogen, it is of advantage to recycle a gaseous fraction that is relatively poor in nitrogen and evacuate a gaseous fraction that is relatively rich in nitrogen. In this case, the process can be carried out as shown in the diagram of FIG. 6.

In the configuration illustrated in FIG. 6, the natural gas leaving the exchanger E2 by the pipe 11 undergoes a first expansion in the turbine $T_{31}$. At the output of the turbine $T_{31}$, a liquid fraction is collected by a flask B3 then evacuated via the pipe 42 preferably located in the lower part of this flask to a turbine $T_{32}$ where it undergoes a second expansion process. Also collected in the upper part of the flask is a gaseous fraction that is relatively rich in nitrogen, fed by a pipe 40 to a turbine T4 where it is expanded before being sent to the contactor S1, preferably the lower part. On leaving the turbine $T_{32}$, the expanded mixture obtained is evacuated via a pipe 43 and separated in a flask B4 into a liquid fraction that is poor in nitrogen which is evacuated via a pipe 45 located in the lower part of the flask B preferably, and which forms a part of the liquefied natural gas produced, and a gaseous fraction taken from the upper part of the flask that is relatively poor in nitrogen and is sent via a pipe 44 to the exchanger E3 then via the pipe 18 to the exchanger E2, from which it emerges via pipe 19. The pipe 19 is linked to a compressor K3 which recompresses, for example, this gaseous fraction that is relatively poor in nitrogen before it passes on to an exchanger C3, where it is cooled with the cooling fluid, which may be water or air. The compressor K3 preferably incorporates several compression stages between which there will be cooling stages, for example.

The natural gas under pressure leaving the exchanger E3 via the pipe 15 is, for example, expanded in an expansion valve V11 before being fed to the head of the contactor S1.

The gaseous fraction enriched with nitrogen, as a result of rising and coming into contact with the liquid phase in the contactor S1, leaves the contactor via a pipe 46 and is fed to an exchanger E4 from where it may be partially recycled via the pipe 49. A fraction of natural gas under pressure arrives in the exchanger E4 from the pipe 47 and is cooled in the exchanger E4, leaving it via the pipe 48 at a temperature close to the final temperature of the LNG produced. This fraction is then expanded through the valve V10 and fed to the head of the contactor S1.

At the base of the contactor S1, a liquid fraction is collected which is mixed with the liquid fraction arriving via the pipe 45 to form the liquefied natural gas produced, which is evacuated via the pipe 50.

It would not be a departure from the scope of the invention if any other equipment that would enable expansion with mechanical energy were used instead of a turbine.

Clearly, various modifications and/or additions may be made by the man skilled in the art to the method and device described, given by way of example only and not limitative, without departing from the scope of the invention.

We claim:

1. A method for the liquefaction of a natural gas, said method comprising at least the following two steps:

a) cooling the natural gas at a pressure at least greater than or equal to the critical pressure of methane and to a temperature that is such that the natural gas will be in the form of a dense phase at the end of the cooling, and b) expanding and liquefying at least a part of the dense phase from step a) by means of a device which reduces the pressure of the gas by expansion with mechanical energy; changeover from the state of the dense phase to a state of a liquid phase to form a liquefied natural gas occurring without any phase transition.

2. A method for the liquefaction of a natural gas as claimed in claim 1, wherein the liquefied gas is at a pressure substantially close to atmospheric pressure at the end of step b).

3. A method for the liquefaction of a natural gas as claimed in claim 2, wherein the expansion of the liquid phase obtained during step b) continues until a gaseous fraction appears, said method then comprising the following additional steps:

c) separating the liquid phase and the gaseous fraction, d) subjecting the gaseous fraction resulting from step c) to heat exchange with a non-expanded fraction of the natural gas cooled in step a), e) expanding the non-expanded fraction at the end of the heat exchange step d) to form a liquid-vapour mixture which is then separated into a liquid phase and a gaseous fraction, the liquid phases from steps c) and e) are combined to form a liquefied natural gas, and at least a part of the gaseous fractions from steps c) and e) are recompressed and recycled to be cooled in step a).

4. A method for the liquefaction of a natural gas as claimed in claim 2, wherein a turbine is the device in which the natural gas is expanded in step b) from the state of a dense phase to the state of a liquid phase.

5. A method for the liquefaction of a natural gas as claimed in claim 2, wherein during step a), the natural gas is cooled by heat exchange using a gaseous fraction separated from the natural gas prior to step a) said gaseous fraction being expanded in a turbine, the resulting expanded gaseous fraction being at least partially recompressed during a compression stage and recycled.

6. A method for the liquefaction of a natural gas as claimed in claim 3, wherein at least one recycled gaseous fraction is compressed in two stages, the compressed gas being cooled at the end of each of these compression stages by an available ambient cooling medium.

7. A method for the liquefaction of a natural gas as claimed in claim 3, wherein during step a) the natural gas is cooled in a heat exchanger by evaporating a mixture of coolants in the heat exchanger, the mixture thus obtained in a vapour phase then being compressed and condensed by a process of heat exchange with an available ambient cooling medium, then expanded and recycled.

8. A method as claimed in claim 7, wherein the mixture of coolants is expanded and evaporated at at least two different pressure levels.

9. A method for the liquefaction of a natural gas as claimed in claim 2, wherein if the natural gas contains heavy hydrocarbons, the heaviest hydrocarbons contained in the natural gas to be liquefied are separated by means of an adsorption stage prior to step a).

10. A method for the liquefaction of a natural gas as claimed in claim 2, wherein step a) is carried out at a pressure greater than the critical pressure of a gaseous mixture comprising the natural gas.

11. A method for the liquefaction of a natural gas as claimed in claim 10, wherein step a) is carried out at a pressure greater than the cricondenbar of the natural gas to be liquified.

12. A method for the liquefaction of a natural gas as claimed in claim 10, wherein step a) is carried out at a pressure in a range between 7 and 20 MPa.

13. A method for the liquefaction of a natural gas as claimed in claim 12, wherein the temperature of the natural gas at the end of step a) is in the range between 165 K and 230 K.

14. A method for the liquefaction of a natural gas as claimed in claim 3, wherein the gaseous fraction obtained at the end of step b) is greater than or equal to 20%.

15. A method for the liquefaction of a natural gas as claimed in claim 2, wherein if the natural gas contains hydrocarbons that are heavier than methane, these hydrocarbons are separated at least in part during a preliminary step prior to step a) carried out at a lower pressure than the pressure prevailing in step a).

16. A method for the liquefaction of a natural gas as claimed in claim 15, wherein the natural gas is cooled during step a) to a temperature that is such that after expansion a liquid fraction with a concentration of hydrocarbons heavier than methane is produced, this liquid fraction then being separated from the liquified natural gas.

17. A method for the liquefaction of a natural gas as claimed in claim 2, wherein step b) is carried out by expansion in a turbine whose elements are poor heat conductors.

18. A method for the liquefaction of a natural gas as claimed in claim 17, wherein a rotor of the turbine is made from a composite material that is a poor heat conductor.

19. A method for the liquefaction of a natural gas as claimed in claim 2, wherein the heat exchanges during steps a) and d) are carried out in counter-flow exchangers.

20. A method for the liquefaction of a natural gas as claimed in claim 3, wherein the heat exchange of step d) is carried out by passing the natural gas though an exchanger in which there is a temperature difference of less than 5 K on the coldest side of the heat exchanger and a temperature difference of less than 10 K on the hottest side of the heat exchanger.

21. A method for the liquefaction of a natural gas as claimed in claim 2, wherein the expansion during step b) is carried out by means of at least two successive turbines, a liquid-vapour mixture from a first partial expansion being separated into a gaseous fraction and a liquid fraction, the gaseous fraction being sent to step d) and the resulting liquid fraction being expanded in the second turbine, the liquid fraction at the end of this second expansion forming a part of the liquefied natural gas product.

22. A method for the liquefaction of a natural gas as claimed in claim 3, wherein at least one part of the gaseous fraction from step b) is brought into contact by counter-flow with the liquid phase from step e), the resulting liquid phase being reunited with the liquid phase from step b) to form the liquified natural gas and the resulting gaseous fraction being reunited with the gaseous fraction from step e) to form at least a part of a gaseous fraction that is rich in nitrogen and is evacuated.

23. An apparatus for the implementation of the method for liquefaction of a natural gas as claimed in claim 1, wherein said apparatus comprises, in combination, at least one device (E2) for cooling the natural gas to be liquefied under said pressure to form a dense phase from said natural gas, at least one cooling means (R1) for cooling the device (E2), the device (E2) being directly linked to at least one means (T4) for expanding the natural gas in the form of a dense phase in order to liquefy the dense phase.

24. The apparatus for the liquefaction of a natural gas as claimed in claim 23, wherein the means capable of expanding the natural gas in the form of a dense phase comprises at least one expansion turbine, of which at least one element is made from a material that is a poor heat conductor.

* * * * *